US010156021B2

(12) United States Patent
Yoshimura et al.

(10) Patent No.: US 10,156,021 B2
(45) Date of Patent: Dec. 18, 2018

(54) METHOD OF PRODUCING SURFACE-TREATED STEEL SHEET

(71) Applicant: TOYO KOHAN CO., LTD., Tokyo (JP)

(72) Inventors: Kunihiro Yoshimura, Kudamatsu (JP); Naomi Taguchi, Kudamatsu (JP); Satoko Fukutomi, Kudamatsu (JP)

(73) Assignee: TOYO KOHAN CO., LTD., Tokyo (JP)

( * ) Notice: Subject to any disclaimer, the term of this patent is extended or adjusted under 35 U.S.C. 154(b) by 543 days.

(21) Appl. No.: 14/768,687

(22) PCT Filed: Jan. 31, 2014

(86) PCT No.: PCT/JP2014/052054
§ 371 (c)(1),
(2) Date: Aug. 18, 2015

(87) PCT Pub. No.: WO2014/132735
PCT Pub. Date: Sep. 4, 2014

(65) Prior Publication Data

US 2016/0002810 A1 Jan. 7, 2016

(30) Foreign Application Priority Data

Feb. 27, 2013 (JP) ..... 2013-037454

(51) Int. Cl.
*C23F 1/28* (2006.01)
*C23G 1/08* (2006.01)
(Continued)

(52) U.S. Cl.
CPC ..... *C25D 9/10* (2013.01); *C23C 22/34* (2013.01); *C23C 22/83* (2013.01); *C23F 1/28* (2013.01);
(Continued)

(58) Field of Classification Search
CPC ..... C25D 9/10; C23G 1/08–1/088
See application file for complete search history.

(56) References Cited

U.S. PATENT DOCUMENTS

2001/0008141 A1* 7/2001 Lee ..... C23G 1/086 134/3
2005/0067056 A1 3/2005 Shoji et al.
(Continued)

FOREIGN PATENT DOCUMENTS

CN 1561406 A 1/2005
CN 102459697 A 5/2012
(Continued)

OTHER PUBLICATIONS

Office Action dated Sep. 12, 2016 in corresponding Chinese Patent Application No. 201480011034.9 and English translation thereof.
(Continued)

*Primary Examiner* — Bryan D. Ripa
*Assistant Examiner* — Ho-Sung Chung
(74) *Attorney, Agent, or Firm* — Muncy, Geissler, Olds & Lowe, P.C.

(57) ABSTRACT

A method of producing a surface-treated steel sheet is provided. The surface-treated steel sheet includes a layer that contains a metal oxide. The method is characterized by including: dipping a steel sheet for 0.1 to 10 seconds in a treatment liquid that contains at least fluoride ions and has a pH of 2 to 5; and electrically treating by flowing a direct current between the steel sheet and an electrode in a treatment liquid to form a layer that contains a metal oxide on a surface of the steel sheet. According to the present invention, there can be provided a method of producing a surface-treated steel sheet which can enhance the interfacial adhesion with an organic resin layer when the organic resin layer is formed on the metal oxide layer.

7 Claims, 4 Drawing Sheets

(51) Int. Cl.

| | |
|---|---|
| ***C25D 3/44*** | (2006.01) |
| ***C25D 3/54*** | (2006.01) |
| ***C25D 7/00*** | (2006.01) |
| ***C25D 9/10*** | (2006.01) |
| ***C23C 22/34*** | (2006.01) |
| ***C23C 22/83*** | (2006.01) |
| ***C25D 17/10*** | (2006.01) |
| ***C25D 21/12*** | (2006.01) |

(52) U.S. Cl.

CPC ..... *C23G 1/086* (2013.01); *C25D 3/44* (2013.01); *C25D 3/54* (2013.01); *C25D 7/00* (2013.01); *C25D 21/12* (2013.01); *C25D 17/10* (2013.01)

(56) References Cited

U.S. PATENT DOCUMENTS

| | | | | |
|---|---|---|---|---|
| 2007/0181230 | A1* | 8/2007 | Dessis | C21D 1/26 148/575 |
| 2011/0259756 | A1* | 10/2011 | Hirano | C25D 9/10 205/320 |
| 2012/0064369 | A1 | 3/2012 | Tachiki et al. | |
| 2015/0129453 | A1 | 5/2015 | Uchikawa et al. | |

FOREIGN PATENT DOCUMENTS

| | | | |
|---|---|---|---|
| EP | 2690202 | A1 | 1/2014 |
| JP | 10-510593 | A | 2/1984 |
| JP | 59-020499 | A | 2/1984 |
| JP | 2008-277146 | A | 11/2008 |
| JP | 2009-84623 | A | 4/2009 |
| JP | 2010-013728 | A | 1/2010 |
| JP | 2011-012344 | A | 1/2011 |
| JP | 2012-001805 | A | 1/2012 |
| TW | 515852 | B | 1/2003 |
| WO | WO 03/048416 | A1 | 6/2003 |
| WO | WO2012133112 | A1 | 10/2012 |

OTHER PUBLICATIONS

Office Action dated Oct. 11, 2017 in corresponding Chinese application No. 201480011038.7 (w/English-language translation) 14 pages.

The Office Action dated Jun. 14, 2016 in corresponding JP Application No. 2013-037454 and an English language translation thereof is attached hereto, pp. 1-9.

* cited by examiner

METHOD OF PRODUCING SURFACE-TREATED STEEL SHEET

BACKGROUND OF THE INVENTION

1. Technical Field of the Invention

The present invention relates to a method of producing a surface-treated steel sheet.

2. Description of the Related Art

A method using chemical conversion treatment or electrolytic treatment is widely employed as a method of forming an oxide layer of which the main component is an oxide of metal, such as Zr, Al and Ti, on a metal base material. In the method using chemical conversion treatment, a metal oxide layer is formed on a metal base material such that: the metal base material is dipped in a treatment liquid; etching treatment is performed for a surface of the metal bate material; the pH in the vicinity of the surface of the metal base material is increased thereby to deposit a metal oxide on the surface of the metal base material. In the method using electrolytic treatment, a metal oxide layer is formed on a metal base material such that: the metal base material is dipped in a treatment liquid; hydrogen is generated at a surface of the metal base material by means of electrolysis of water; and the pH in the vicinity of the surface of the metal base material is thereby increased to deposit an oxide.

When a surface-treated steel sheet obtained by forming a metal oxide layer on a metal base material is used as a material for metal cans, etc, the material is used after being coated with an organic resin layer, such as coating material and layer, in general. Therefore, the metal oxide layer formed on the metal base material is required to have enhanced interfacial adhesion with the organic resin layer.

To this end, for example, Patent Document 1 (Japanese Patent Application Publication No. 2010-13728) discloses, as a method of enhancing such interfacial adhesion between the metal oxide layer and the organic resin layer, a technique of adding an organic resin component to a treatment liquid that contains metal ions when forming the metal oxide layer by means of chemical conversion treatment or electrolytic treatment using the treatment liquid so that the metal oxide layer to be formed contains the organic resin component.

SUMMARY OF THE INVENTION

According to the above technique described in Patent Document 1, however, when the amount of the organic resin component is unduly large in the metal oxide layer, the electrical resistance of the metal oxide layer increases to deteriorate the weldability. Therefore, the amount of organic resin component that can be contained in the metal oxide layer is limited, and the interfacial adhesion between the metal oxide layer and the organic resin layer can only be enhanced to some extent.

As another method of enhancing the interfacial adhesion between the metal oxide layer and the organic resin layer, there may be considered a method of forming a primer layer on the metal oxide layer. When a primer layer is merely formed on the outermost layer of the metal oxide layer, however, the primer layer itself may possibly delaminate if a stress or heat is applied to the metal oxide layer, so that the effect of enhancing the interfacial adhesion between the metal oxide layer and the organic resin layer cannot be sufficiently obtained, which may be problematic.

The present invention has been created in view of such actual circumstances, and an object of the present invention is to provide a method of producing a surface-treated steel sheet which can form a dense metal oxide layer on a metal base material thereby to enhance the interfacial adhesion with an organic resin layer when the organic resin layer is formed on the metal oxide layer.

As a result of intensive studies to achieve the above object, the present inventors have found that the above object can be achieved by dipping a steel sheet in a specific dip treatment liquid for 0.1 to 10 seconds and thereafter performing electrolytic treatment to form a layer that contains a metal oxide on a surface of the steel sheet. The inventors have thus accomplished the present invention.

That is, according to an aspect of the present invention, there is provided a method of producing a surface-treated steel sheet. The surface-treated steel sheet comprises a layer that contains a metal oxide. The method is characterized by comprising: dipping a steel sheet for 0.1 to 10 seconds into a treatment liquid that contains at least fluoride ions and has a pH of 2 to 5; and electrically treating by flowing a direct current between the steel sheet and an electrode in a treatment liquid to form a layer that contains a metal oxide on a surface of the steel sheet.

The treatment liquid for dip and the treatment liquid for electrolytic treatment may be the same treatment liquid, or another treatment liquid may be used to perform electrolytic treatment after the dip is performed.

In the producing method of the present invention, it is preferred that the dipping includes continuously feeding the steel sheet into a dip treatment bath that comprises a dip treatment liquid thereby to dip the steel sheet in the dip treatment liquid, and electrically treating includes, after dipping the steel sheet in the dip treatment liquid, continuously feeding the steel sheet into an electrolytic treatment bath that comprises a metal ion-containing electrolytic treatment liquid and an electrode and performing electrolytic treatment by flowing a direct current between the steel sheet and the electrode in the electrolytic treatment liquid.

In the producing method of the present invention, it is preferred that the dip treatment liquid contains a part of constituents of those contained in the electrolytic treatment liquid.

In the producing method of the present invention, it is preferred that aqueous solutions that contain the same constituents are used as the dip treatment liquid and the electrolytic treatment liquid.

In the producing method of the present invention, it is preferred that aqueous solutions that contain the same constituents at the same content ratio are used as the dip treatment liquid and the electrolytic treatment liquid.

In the producing method of the present invention, it is preferred that the electrolytic treatment liquid contains ions of at least one kind of metal selected from Zr, Al and Ti.

In the producing method of the present invention, it is preferred that the steel sheet is a cold-rolled steel sheet, or a steel sheet comprising a nickel plated layer, from which iron is exposed at least one surface thereof.

In the producing method of the present invention, it is preferred that a molar concentration of metal in the layer formed on the surface of the steel sheet is 0.3 mmol/$m^2$ or more.

In the producing method of the present invention, it is preferred that the layer that contains a metal oxide is formed on the surface of the steel sheet without pickling the steel sheet with acid.

According to the present invention, there can be provided a method of producing a surface-treated steel sheet which can enhance the interfacial adhesion with an organic resin layer when the organic resin layer is formed on the metal oxide layer.

DESCRIPTION OF THE PREFERRED EMBODIMENT

Embodiments of the present invention will hereinafter be described with reference to the drawings.

Figure 1:
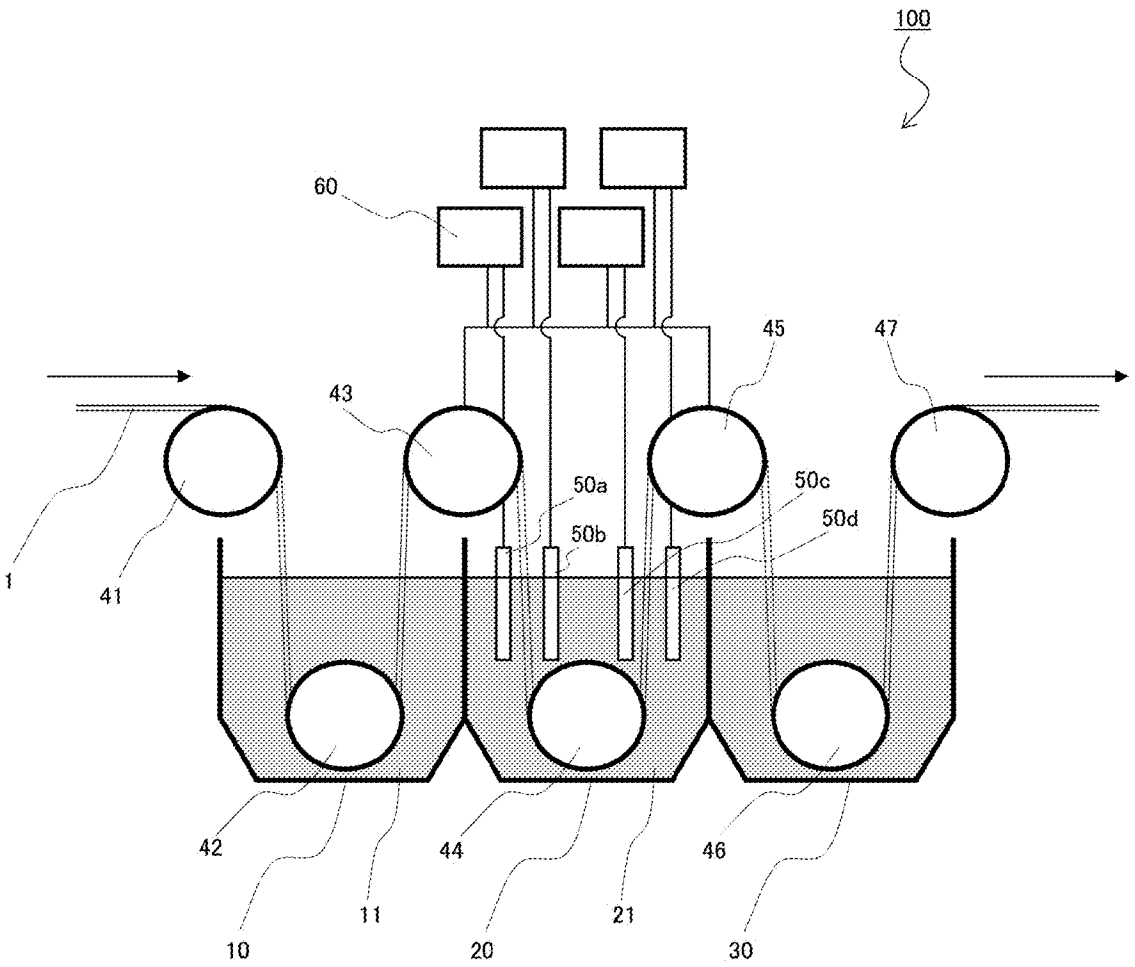
FIG. 1 is a view illustrating an example of a configuration of a surface treatment line according to the present embodiment.

FIG. 1 is a view illustrating a configuration of a surface treatment line 100 to be used in the producing method of the present embodiment. The surface treatment line 100 of the present embodiment is a line for producing a surface-treated steel sheet obtained by forming metal oxide layers on a base material 1, and comprises, as illustrated in FIG. 1, a dip treatment bath 10, an electrolytic treatment bath 20, a rinsing treatment bath 30, carrier rolls 41, 43, 45 and 47, and sink rolls 42, 44 and 46. In addition, a plurality of anodes 50*a* to 50*d* and a plurality of rectifiers 60 are provided in and around the electrolytic treatment bath 20. Among these carrier rolls, the carrier rolls 43 and 45 are connected electrically to an external power source (not shown) via the rectifiers 60, and currents thereby flows through the carrier rolls 43 and 45. Therefore, the carrier rolls 43 and 45 have functions as conductor rolls that can energize the base material 1 while carrying the base material 1. The anodes 50*a* to 50*d* are also connected electrically to the above external power source via the rectifiers 60, and currents thereby flow through the anodes 50*a* to 50*d*. Therefore, the anodes 50*a* to 50*d* act as electrodes when electrolytic treatment is performed for the base material 1.

According to the present embodiment, the base material 1 is fed, in the surface treatment line 100, by each carrier roll into each of the dip treatment bath 10, the electrolytic treatment bath 20 and the rinsing treatment bath 30 in this order, and each treatment is performed in each treatment bath. Specifically, the base material 1 is first fed into the dip treatment bath 10 filled with a dip treatment liquid 11 which performs removal of scales (oxidized layers) from the surfaces of the base material 1 and etching treatment for the surfaces of the base material 1. Subsequently, the base material 1 is fed into the electrolytic treatment bath 20 filled with an electrolytic treatment liquid 21 in which, when the base material 1 faces the anodes 50*a* to 50*d*, the electrolytic treatment is performed due to actions of direct currents applied from the power source via the carrier rolls 43 and 45 through which the currents flow, and metal oxide layers are formed on the surfaces of the base material 1. Thereafter, the base material 1 is fed into the rinsing treatment bath 30 filled with water in which the base material 1 is washed with the water so that the electrolytic treatment liquid 21 remaining on the base material 1 is washed away. Water washing may be performed using a water washing spray.

The base material 1 is not particularly limited. For example, there can be used a hot-rolled steel sheet such as based on an aluminum-killed steel continuously cast material, a cold-rolled steel sheet obtained by cold-rolling the hot-rolled steel sheet, and a steel sheet that comprises the hot-rolled or cold-rolled steel sheet and a plated layer thereon including metal, such as Zn, Sn, Ni, Cu and Al. Among them, a cold-rolled steel sheet from which iron is exposed at least one surface thereof may preferably be used because the interfacial adhesion can readily be enhanced between the outermost surface of the base material and the metal oxide layer.

The dip treatment bath 10, filled with the dip treatment liquid 11, is a treatment bath for performing removal of scales (oxidized layers) from the surfaces of the base material 1 and etching treatment for the surfaces of the base material 1. The base material 1 is fed into the dip treatment bath 10 by the carrier roll 41 and dipped in the dip treatment liquid 11, which thereby acts to perform the etching treatment for the surfaces of the base material 1.

The electrolytic treatment bath 20, filled with the electrolytic treatment liquid 21, is a bath for forming metal oxide layers on the base material 1 by means of electrolytic treatment. The base material 1 is fed by the carrier roll 43 into the electrolytic treatment bath 20, in which the electrolytic treatment is performed for the base material 1 due to actions of the anodes 50*a* to 50*d* in the electrolytic treatment liquid 21.

The rinsing treatment bath 30, filled with water, is a bath for washing the base material 1 with the water. The base material 1 is fed by the carrier roll 45 into the rinsing treatment bath 30, in which the base material 1 is dipped in the water, and the electrolytic treatment liquid 21 remaining on the surfaces of the base material 1 is thereby washed away.

Here, detailed features of the dip treatment bath 10 in the present embodiment will be described.

The dip treatment liquid 11 filling the dip treatment bath 10 is an aqueous solution that contains at least fluoride ions and has a pH of 2 to 5. The fluoride ions act to perform removal of scales from the surfaces of the base material 1 and etching treatment for the surfaces of the base material 1. This allows exposure of active surfaces on the base material 1.

It is enough if the dip treatment liquid 11 contains at least fluoride ions, but the dip treatment liquid 11 may preferably contain a part of constituents of those contained in the electrolytic treatment liquid 21 in the electrolytic treatment bath 20 to be described later, may more preferably contain the same constituents as those contained in the electrolytic treatment liquid 21, and particularly preferably contain the same constituents as those contained in the electrolytic treatment liquid 21 at the same content ratio. By using aqueous solution that contains such common constituents with those in the electrolytic treatment liquid 21 as the dip treatment liquid 11, the types of constituents contained in the electrolytic treatment liquid 21 and the content ratio of each constituent can be suppressed from varying even if the dip treatment liquid 11 remaining on the base material 1 is mixed into the electrolytic treatment liquid 21 when the base material 1 is carried along the surface treatment line 100. According to the present embodiment, it is thus possible to prevent the variation in the composition of the electrolytic treatment liquid 21 due to mixture of the dip treatment liquid 11 into the electrolytic treatment liquid 21, and therefore, a water washing treatment step is not required to be provided between the dip treatment bath 10 and the electrolytic treatment bath 20 to prevent the mixture of the dip treatment liquid 11 into the electrolytic treatment liquid 21 due to the dip treatment liquid 11 remaining on the base material 1. This allows the production cost to be reduced.

Fluoride for providing the fluoride ions contained in the dip treatment liquid 11 is not particularly limited. For example, there can be used zirconium ammonium fluoride, aluminum fluoride, titanium fluoride, sodium fluoride, hydrofluoric acid, calcium fluoride, hexafluorosilicate, sodium hexafluorosilicate, and other appropriate compounds.

The pH of the dip treatment liquid 11 is 2 to 5, and may preferably be 2.5 to 4. Unduly low pH causes the surfaces of the base material 1 to be excessively etched, so that the metal oxide layers are difficult to be formed on the surfaces of the base material 1. On the other hand, unduly high pH may possibly deteriorate the effect of etching to the base material 1.

The period of time for dipping the base material 1 in the dip treatment liquid 11 in the dip treatment bath 10 is 1 to 10 seconds, and may preferably be 0.4 to 5 seconds. According to the present embodiment, the treatment liquid having the above features is used as the dip treatment liquid 11 and the period of time for dipping the base material 1 in the dip treatment liquid 11 is set within the above range. These features of the present embodiment allow the dip treatment liquid 11 to appropriately remove the scales from the surfaces of the base material 1 and also allow the etching treatment to appropriately expose the active surfaces of the base material 1. This leads to an effect that the metal oxide layers formed in the electrolytic treatment bath 20 to be described later can have a dense structure in which micro defects are suppressed from occurring. If the dipping time is unduly short, the exposure of the active surfaces will be insufficient at the base material 1, so that micro defects may possibly occur in the metal oxide layers to be formed. If, on the other hand, the dipping time is unduly long, the etching will excessively corrode the base material 1, and problems may arise in that the productivity deteriorates, the composition of the dip treatment liquid 11 becomes unstable, and the production efficiency deteriorates because the treatment in the dip treatment bath 10 is rate-determining.

Detailed features of the electrolytic treatment bath 20 in the present embodiment will then be described.

As illustrated in FIG. 1, four anodes 50*a* to 50*d* are dipped in the electrolytic treatment liquid 21 in the electrolytic treatment bath 20, and a plurality of rectifiers 60 are provided outside the electrolytic treatment bath 20. The rectifiers 60 are connected to an external power source (not shown) and also connected to each of the anodes 50*a* to 50*d* which are dipped in the electrolytic treatment liquid 21. This allows a current to flow through each anode, which therefore acts as an oxidation electrode (electrode at which electrons are extracted) for the base material 1 when the electrolytic treatment is performed.

All of the rectifiers 60 connected to the anodes are also connected electrically to the carrier rolls 43 and 45. This allows currents to flow through the carrier rolls 43 and 45, which therefore act as conductor rolls that can cause the currents to flow through the base material 1 while carrying the base material 1. Thus, the carrier rolls 43 and 45 energize the base material 1, which is fed in the energized state into the electrolytic treatment bath 20, so that the electrolytic treatment is performed due to actions of the anodes 50*a* to 50*d* to form the metal oxide layers on the base material 1.

It is preferred to use, as the material for each anode, an insoluble metal such as platinum and stainless steel or a coating metal such as titanium deposited thereon with iridium oxide because they have high electrochemical stability. The rectifiers 60 are not particularly limited. Rectifiers known in the art can be used depending on the magnitude of electrical power supplied to each carrier roll and each anode.

The electrolytic treatment liquid 21 filling the electrolytic treatment bath 20 is an aqueous solution that contains: metal ions for forming the metal oxide layers on the base material 1; and fluoride ions. The electrolytic treatment liquid 21 may preferably contain, as the metal ions, ions of at least one kind of metal selected from Zr, Al and Ti because they can well form the metal oxide layers on the base material 1, and particularly preferred are Zr ions. The metal ions that constitute the electrolytic treatment liquid 21 are to be deposited as metal oxide on the base material 1 due to the electrolytic treatment thereby to form the metal oxide layers.

Metal compounds for providing the metal ions that constitute the electrolytic treatment liquid 21 are not particularly limited. Examples of the metal compounds used to provide Zr ions include $KZrF_6$, $(NH_4)_2ZrF_6$, $(NH_4)_2ZrO(CO_3)_2$, $ZrO(NO_3)_2$, and $ZrO(CH_3COO)_2$. Examples of the metal compounds used to provide Al ions include $Al(NO_3)_3.9H_2O$, $AlK(SO_4)_2.12H_2O$, $Al_2(SO_4)_3.13H_2O$, $Al(H_2PO_4)_3$, $AlPO_4$, and $[CH_3CH(OH)COO]_3Al$. Examples of the metal compounds used to provide Ti ions include $K_2TiF_6$, $(NH_4)_2TiF_6$, $Na_2TiF_6$, $K_2TiO(C_2O_4)_2.2H_2O$, $TiCl_3$, and $TiCl_4$. In the present embodiment, one kind of the above-described metal compound may be solely used, or two or more kinds may be used in combination.

When the dip treatment liquid 11 used in the dip treatment bath 10 contains the same constituents as those in the electrolytic treatment liquid 21, the above-described metal compounds can be used.

The electrolytic treatment liquid 21 contains fluoride ions in addition to the above-described metal ions. In general, the fluoride ions act as complexing agents for enhancing the solubility of ions of metal such as Zr, Al and Ti in the liquid. Fluoride for providing the fluoride ions is not particularly limited. The above-described fluoride as used in the dip treatment liquid 11 in the dip treatment bath 10 can be used. In an alternative embodiment, cyanide or other appropriate compound may be used as a complexing agent in addition to the fluoride.

To enhance the conductivity of the treatment liquid, an electrolyte such as nitrate ions and ammonium ions may be contained in the electrolytic treatment liquid 21 to such an extent that does not inhibit the formation of the metal oxide layers.

Organic acid such as polyacrylic acid, polyitaconic acid, citric acid, lactic acid, tartaric acid and glycolic acid or phenolic resin may be added to the electrolytic treatment liquid 21. By adding such an additive, when organic resin layers such as coatings and layers are formed on the metal oxide layers, the interfacial adhesion can be more improved between the metal oxide layers and the organic resin layers.

Such complexing agents, electrolytes and additives as contained in the electrolytic treatment liquid 21 may also be contained in the dip treatment liquid 11 in the dip treatment bath 10.

According to the present embodiment, after the dip treatment bath 10 is used to perform removal of scales from the surfaces of the base material 1 and etching treatment for the surfaces of the base material 1, the electrolytic treatment bath 20 having the above-described features is used to perform electrolytic treatment for the base material 1 to form the metal oxide layers on the base material 1, as will be described below.

First, the base material 1 is fed into the electrolytic treatment bath 20 by the carrier roll 43, and carried through between the anodes 50*a* and 50*b* dipped in the electrolytic treatment liquid 21 in the electrolytic treatment bath 20. The base material 1 faces the anodes 50*a* and 50*b* when passing through between the anodes 50*a* and 50*b*, and cathode electrolytic treatment is performed due to actions of the direct currents applied from the power source via the carrier rolls 43 and 45 through which the currents flow, so that the metal oxide layers are formed on the surfaces of the base material 1.

Specifically in the cathode electrolytic treatment, currents flow between the base material 1 and the anodes 50*a* and 50*b* to generate hydrogen in the vicinity of the surfaces of the base material 1 due to electrolysis of water in the electrolytic treatment liquid 21. This increases the pH in the vicinity of the surfaces of the base material 1, and the increased pH causes metal ions contained in the electrolytic treatment liquid 21 to be deposited as an oxide. The metal oxide layers are thus formed on the base material 1. For example, when the electrolytic treatment liquid 21 contains Zr ions, metal oxide layers that contain an oxide of Zr are formed on the base material 1. In a similar manner, when the electrolytic treatment liquid 21 contains Al ions, for example, metal oxide layers that contain an oxide of Al are formed on the base material 1. When the electrolytic treatment liquid 21 contains Ti ions, metal oxide layers that contain an oxide of Ti are formed on the base material 1.

After the cathode electrolytic treatment is performed due to actions of the anodes 50*a* and 50*b*, the sink roll 44 turns the traveling direction of the base material 1, which then faces the anodes 50*c* and 50*d* in the electrolytic treatment liquid 21, so that the cathode electrolytic treatment is performed again to further form metal oxide layers on the base material 1. The base material 1 is then lifted out of the electrolytic treatment bath 20 by the carrier roll 45. In this way, the electrolytic treatment bath 20 is used to perform the electrolytic treatment for the base material 1, according to the present embodiment.

The amount of the metal oxide layers may preferably be 0.3 mmol/$m^2$ or more, and more preferably 0.5 mmol/$m^2$ or more, as a molar concentration of the metal contained in the metal oxide layers.

According to the present embodiment, the base material 1 is dipped for 0.1 to 10 seconds in the dip treatment liquid 11 which contains at least fluoride ions and has a pH of 2 to 5, and it is thereby possible to appropriately remove the scales from the surfaces of the base material 1 and appropriately expose the active surfaces of the base material 1 due to the etching treatment. This allows the metal oxide layers to be formed with a dense structure in which the formation of nonuniform layer is suppressed. It thus appears that, when organic resin layers are formed on the metal oxide layers, the delamination between the base material and the metal oxide layers (metal-oxygen compound layers) can be prevented, and the interfacial adhesion with the organic resin layers can be enhanced.

In a configuration of the conventional surface treatment line, a part of each anode is located above the liquid surface of the electrolytic treatment liquid in the electrolytic treatment bath. As such, immediately after the base material is carried into the electrolytic treatment liquid, hydrogen is generated due to electrolysis of water in the electrolytic treatment liquid to increase the pH in the vicinity of the surfaces of the base material, and the increased pH causes the metal ions contained in the electrolytic treatment liquid to be deposited as an oxide, so that the metal oxide layers (metal-oxygen compound layers) are formed on the base material. That is, the dipping time is zero seconds, and the metal oxide layers (metal-oxygen compound layers) are formed in a state in which the scales remain on the surfaces and the surfaces are not activated.

As a method of removing the scales from the surfaces of the base material 1, there has conventionally been performed a method of pickling the base material 1 with acid using an acid pickling liquid which is ordinarily used for steel sheets. According to the method by acid pickling, however, after the base material 1 is pickled with the acid pickling treatment liquid such as hydrochloric acid and sulfuric acid, the acid pickling treatment liquid remaining on the base material 1 is mixed in the electrolytic treatment bath thereby to lead to a trouble of varying the types of constituents contained in the electrolytic treatment liquid in the electrolytic treatment bath and the content ratio of each constituent. To prevent the acid pickling treatment liquid from being mixed in the electrolytic treatment bath, there may be employed a method of, after pickling the base material 1 with acid, washing the base material 1 with water to remove the acid pickling treatment liquid remaining on the surfaces of the base material 1. In this case, however, the water washing may form scales again on the surfaces of the base material 1, and the activities of the surfaces will be lost, which may be problematic. Therefore, the metal oxide layers formed through the electrolytic treatment will not be dense in this case, resulting in a trouble of deteriorating the interfacial adhesion with the organic resin layers.

In contrast, according to the present embodiment, aqueous solution that contains fluoride ions, which is also used as the electrolytic treatment liquid 21, is used as the dip treatment liquid 11 for performing removal of scales and etching. Therefore, even when the dip treatment liquid 11 remaining of the base material 1 is mixed in the electrolytic treatment liquid 21, it is possible to make a dense metal oxide layers formed through the electrolytic treatment while effectively suppressing the variations in the types of constituents contained in the electrolytic treatment liquid 21 and the content ratio of each constituent.

Moreover, according to the present embodiment, the dip treatment liquid 11 contains fluoride ions which are strongly corrosive. Therefore, not only the removal of scales from the surfaces of the base material 1 can be performed as with the above case of using an acid pickling treatment liquid such as hydrochloric acid and sulfuric acid, but the etching treatment can also be performed for the surfaces of the base material 1. In some cases such as a case in which the scale layers on the surfaces of the base material 1 have a large thickness, the same effects can be obtained even when the removal of scales, the etching and the electrolytic treatment, etc., are performed according to the present embodiment after the conventional treatment is performed using an acid pickling treatment liquid. This will increase costs such as for the acid pickling treatment liquid, however.

On the other hand, according to the method of causing the metal oxide layers to contain an organic resin component in order to enhance the interfacial adhesion between the metal oxide layers and the organic resin layers, when the amount of the organic resin component is unduly large in the metal oxide layers, the electrical resistance of the metal oxide layers increases to deteriorate the weldability. Therefore, the amount of organic resin component that can be contained in the metal oxide layers is limited, and the interfacial adhesion with the organic resin layers can only be enhanced to some extent. In contrast, according to the present embodiment, the etching treatment for the base material 1 allows dense metal oxide layers to be formed on the base material 1 thereby to sufficiently enhance the interfacial adhesion between the metal oxide layers and the organic resin layers.

Furthermore, according to the present embodiment, the metal oxide layers are formed through the electrolytic treatment, which therefore does not lead to a trouble in the method of forming the metal oxide layers through chemical conversion treatment, i.e., a trouble that the rate of forming the metal oxide layers is limited depending on the chemical reaction rate.

The above-described embodiment exemplifies a configuration in which the dip treatment bath 10 is used as a treatment bath for performing the removal of scales from the surfaces of the base material 1 and the etching treatment for the surfaces of the base material 1. In an alternative embodiment, as illustrated in FIG. 2, for example, a surface treatment line 100*a* may be configured such that the dip treatment bath 10 is used as a treatment bath for performing, in addition to the removal of scales from the surfaces of the base material 1 and the etching treatment for the surfaces of the base material 1, the electrolytic treatment for the base material 1.

Figure 2:
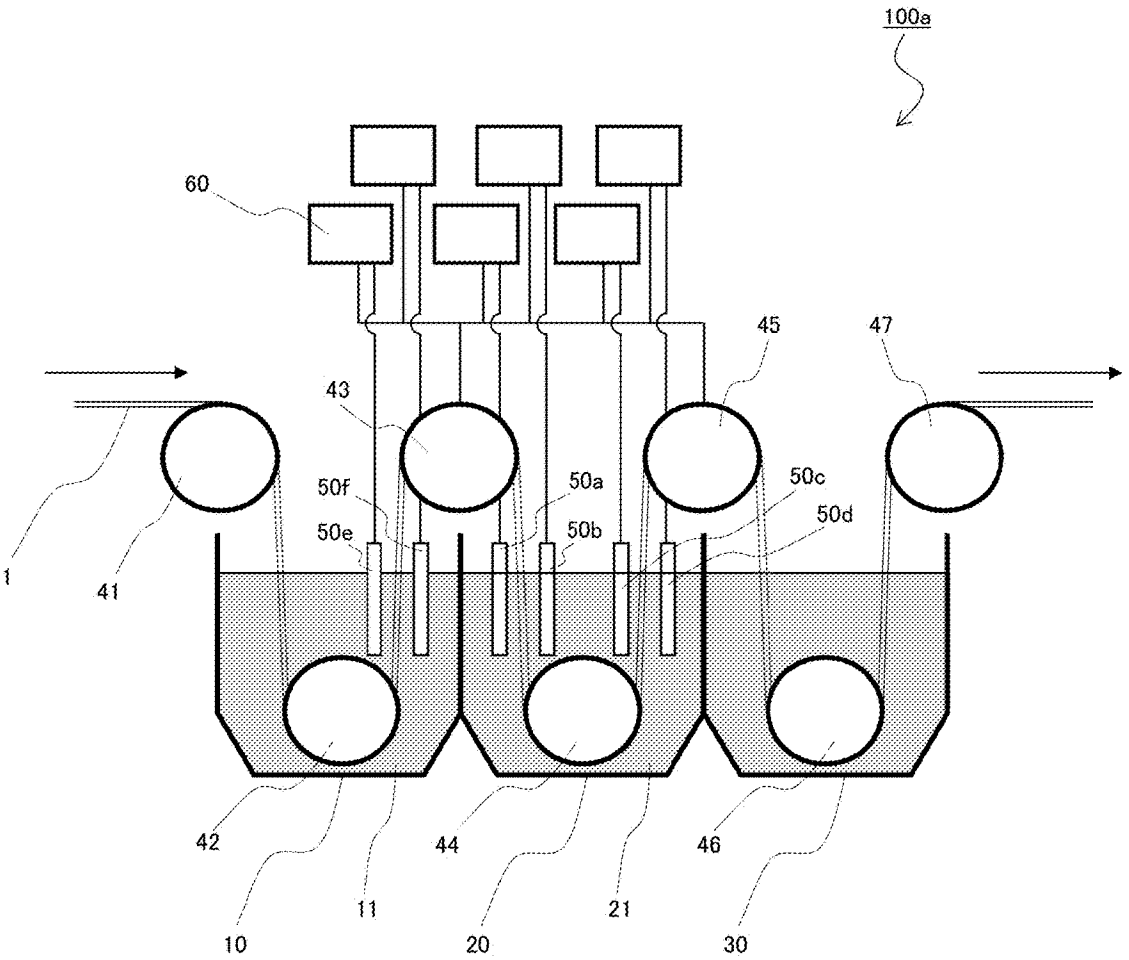
FIG. 2 is a view illustrating another example of a configuration of a surface treatment line according to the present embodiment.

Here, the surface treatment line 100*a* illustrated in FIG. 2 is configured such that two anodes 50*e* and 50*f* and two rectifiers 60 connected to these anodes, which are located in and around the dip treatment bath 10, are added to the surface treatment line 100 illustrated in FIG. 1.

In the surface treatment line 100*a* illustrated in FIG. 2, the base material 1 is first dipped in the dip treatment liquid 11 in the dip treatment bath 10 so that the removal of scales from the surfaces of the base material 1 and the etching treatment for the surfaces of the base material 1 are performed, and then faces the anodes 50*e* and 50*f* in the dip treatment liquid 11 so that first-round cathode electrolytic treatment is performed. Thereafter, the base material 1 is dipped in the electrolytic treatment liquid 21 in the electrolytic treatment bath 20 so that the anodes 50*a* and 50*b* perform second-round cathode electrolytic treatment and the anodes 50*c* and 50*d* then perform third-round cathode electrolytic treatment. This allows the base material 1 to undergo first the removal of scales and the etching treatment in the dip treatment bath 10 and thereafter the formation of the metal oxide layers through the cathode electrolytic treatment performed three times in the dip treatment bath 10 and the electrolytic treatment bath 20.

Therefore, in order to form uniform metal oxide layers in each of the dip treatment bath 10 and the electrolytic treatment bath 20, aqueous solution that contains the same constituents may be used as the dip treatment liquid 11 in the dip treatment bath 10 and as the electrolytic treatment liquid 21 in the electrolytic treatment bath 20. Specifically, aqueous solution that contains at least fluoride ions and metal ions and has a pH of 2 to 5 may be used as each of the dip treatment liquid 11 and the electrolytic treatment liquid 21.

Figure 3:
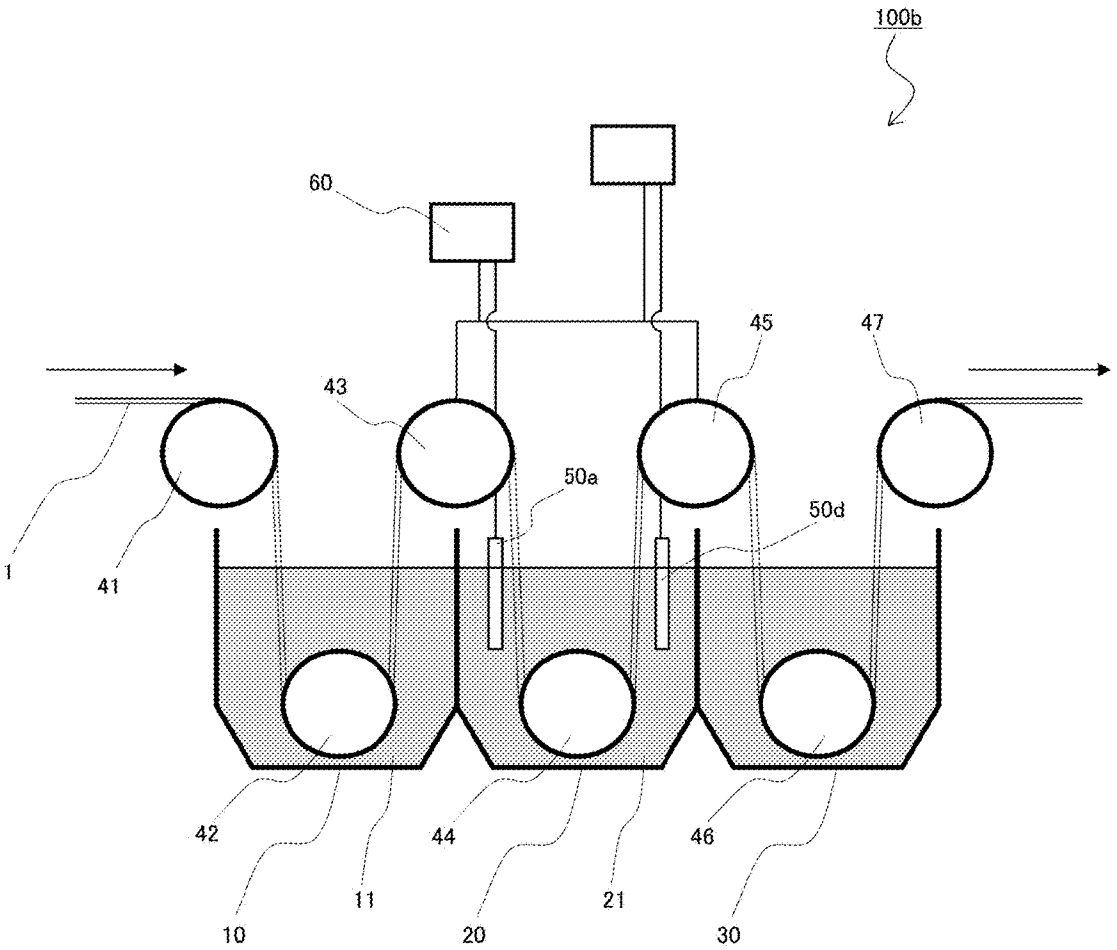
FIG. 3 is a view illustrating still another example of a configuration of a surface treatment line according to the present embodiment.

The above-described surface treatment line 100 illustrated in FIG. 1 is exemplified as a configuration in which four anodes are provided in the electrolytic treatment bath 20. In an alternative embodiment, as illustrated in FIG. 3, for example, a surface treatment line 100*b* may be configured to reduce the number of anodes such that two anodes are provided in the electrolytic treatment bath 20.

In the above-described embodiments, the electrolytic treatment liquid 21 in the electrolytic treatment bath 20 may be used while being appropriately circulated using a pump or other appropriate means. This allows suppressing the increase of impurities in the electrolytic treatment liquid 21 and the variation in the content ratio of each constituent, etc., when the electrolytic treatment liquid 21 is continuously used. For example, after preliminarily preparing a larger amount of the electrolytic treatment liquid 21 than the volume of the electrolytic treatment bath 20 and storing a part of the prepared electrolytic treatment liquid 21 in a treatment liquid bath (not shown) provided outside the electrolytic treatment bath 20, the electrolytic treatment liquid 21 may be circulated between the treatment liquid bath and the electrolytic treatment bath 20 using a pump or other appropriate means. Similarly, the dip treatment liquid 11 may be used while being circulated between the dip treatment bath 10 and a treatment liquid bath provided outside the dip treatment bath 10. According to such circulation of the treatment liquid, it is possible to suppress the variations in the types of constituents contained in the dip treatment liquid 11 and the electrolytic treatment liquid 21 and the content ratio of each constituent, and the etching treatment and the electrolytic treatment can be well performed for the base material 1.

In the above-described embodiments, the surface treatment line 100 includes one dip treatment bath 10, one electrolytic treatment bath 20, and one rinsing treatment bath 30, but the number of those baths is not particularly limited, and respective two or more baths may be provided.

Each carrier roll provided in the surface treatment line 100 is exemplified as one roll, but may comprise two or more rolls. For example, the carrier roll 43, which is a roll for lifting the base material 1 out of the dip treatment bath 10 and feeding the base material 1 into the electrolytic treatment bath 20, may comprise a roll for lifting the base material 1 out of the dip treatment bath 10 and a roll for feeding the base material 1 into the electrolytic treatment bath 20. Material of each carrier roll is not particularly limited. For the carrier rolls through which no currents flow, electrically insulating material such as rubber may be used, for example.

Each carrier roll may be provided with a nip roll for holding the base material 1 when carrying the base material 1 and/or a ringer roll for removing the treatment liquid remaining on the surface of the base material 1 not facing the carrier roll to prevent the treatment liquid from being brought outside the treatment bath.

EXAMPLES

Hereinafter, the present invention will be specifically described with reference to examples, but the present invention is not limited to these examples.

Evaluation method for each property is as follows.

<Measurement of Zr Amount in Metal Oxide Layers>

For the surfaces of a surface-treated steel sheet obtained by forming metal oxide layers on a steel sheet, the amount of deposited Zr was measured using an X-ray fluorescence spectrometer (available from Rigaku Corporation, model number: ZSX100e). The measurement of the Zr amount in the metal oxide layers was performed for all of the examples and the comparative examples to be described later.

<Evaluation of Cross-Cut Corrosion Resistance of Metal Can>

For a metal can obtained by working an organic resin-coated steel sheet, a sidewall part of the can was cut out, and ends of the can sidewall part thus cut out were covered by tapes. Thereafter, cross-cut scratches of a length of 4 cm were made using a cutter so as to reach the steel sheet as a raw material at a portion of the surface to be the inside of the can. The height of the portion was 50 mm from the can bottom. Subsequently, the organic resin-coated steel sheet formed with the cross-cut scratches was held in a state of being dipped in a commercially available coffee beverage (product name of Blendy-bottled coffee, low-sugar, available from AJINOMOTO GENERAL FOODS, INC.) under conditions of a temperature of 37° C. and a period of holding of 8 weeks. During this operation, the coffee beverage was appropriately changed to new one so as not to turn moldy. Thereafter, the area of a discolored portion of the organic resin-coated steel sheet at the cross-cut part was determined on the basis of the criteria below, and the cross-cut corrosion resistance of the metal can was evaluated. The cross-cut corrosion resistance of the metal can is to represent the interfacial adhesion of organic resin layers in the organic resin-coated steel sheet, and was evaluated on the basis of the criteria below. If the evaluation of an organic resin-coated steel sheet is 4-point or higher, interfacial adhesion of the organic resin layers is well, and invasion of liquid at scratch part can be prevented even when scratches occur on the surface. In this case, therefore, the organic resin-coated steel sheet can be suitably used for metal cans. The cross-cut corrosion resistance of the metal can was evaluated only for Examples 1 to 3 and Comparative Examples 1 to 8 among the following examples and comparative examples.

5-point: Discolored portion had a diameter of less than 0.5 mm from the cross-cut part.

4-point: Discolored portion had a diameter of 0.5 mm or more and less than 1.0 mm from the cross-cut part.

3-point: Discolored portion had a diameter of 1.0 mm or more and less than 2.0 mm from the cross-cut part.

2-point: Discolored portion had a diameter of 2.0 mm or more and less than 3.0 mm from the cross-cut part.

1-point: Discolored portion had a diameter of 3.0 mm or more from the cross-cut part.

Example 1

A known cold-rolled low-carbon steel sheet (thickness of 0.225 mm and width of 200 mm) was prepared as a raw sheet.

The prepared steel sheet was electrolytically degreased in aqueous solution obtained by dissolving a commercially available degreasing agent (Formula 618-TK2 available from Nippon Quaker Chemical, Ltd.) and then washed with water, and the surface treatment line 100 illustrated in FIG. 1 was used to perform etching treatment and electrolytic treatment for the surfaces of the steel sheet. Specifically, the steel sheet was first fed into the dip treatment bath 10 by the carrier roll 41, and dipped in the dip treatment liquid 11 under the conditions below to etch the surfaces of the steel sheet.

Composition of dip treatment liquid 11: Aqueous solution of a Zr concentration of 1,000 weight ppm and a F concentration of 1,500 weight ppm obtained by dissolving zirconium ammonium fluoride as a Zr compound into water pH of dip treatment liquid: 2.5

Temperature of dip treatment liquid: 40° C.

Dipping time: 5 seconds

After the surfaces of the steel sheet was etched, the steel sheet was fed into the electrolytic treatment bath 20 by the carrier roll 43 so that cathode electrolytic treatment was performed due to actions of the anodes 50*a* and 50*d* and the anodes 50*b* and 50*c* to form metal oxide layers on the steel sheet. The cathode electrolytic treatment was performed to form the metal oxide layers on the steel sheet by using, as the electrolytic treatment liquid 21, the same aqueous solution as the dip treatment liquid 11 under the conditions of: a line speed (traveling speed of steel sheet) of 20 m/min; a current density in the steel sheet of 2 A/dm$^2$; an energizing time of 0.6 seconds; an outage time of 2.5 seconds; and a cycle number of 2. The energizing time refers to a time during which the steel sheet passes through in the vicinity of the anodes in the surface treatment line 100, i.e., a time during which the cathode electrolytic treatment is performed for the steel sheet. The outage time refers to a time from when the cathode electrolytic treatment was completed for the steel sheet to when the subsequent cathode electrolytic treatment is performed. The cycle number refers to the number of times to perform electrolytic treatment for the steel sheet using anodes. (In the present example, the cycle number is 2 because 2 sets of anodes, i.e., the anodes 50*a* and 50*d* and the anodes 50*b* and 50*c*, are used.)

After the metal oxide layers were formed on the steel sheet by means of cathode electrolytic treatment, the steel sheet was lifted out of the electrolytic treatment bath 20 by the carrier roll 45 and fed into the rinsing treatment bath 30 filled with water, in which the steel sheet was washed with the water and then dried. The surface-treated steel sheet was thus obtained.

For the surface-treated steel sheet thus obtained, the Zr amount in the metal oxide layers was measured in accordance with the above-described method. The result is listed in Table 1.

Subsequently, the surface-treated steel sheet was heated to 250° C., and one of the surfaces of the surface-treated steel sheet formed with the metal oxide layers (a surface to be located inside a can when the surface-treated steel sheet was worked into the metal can, as will be described later) was laminated, by thermal compression bond using lamination rolls, with a non-orientated polyethylene terephthalate (PET) film (thickness of 20 μm) copolymerized with 15 mol % of isophthalic acid. The laminate was immediately cooled with water, and an organic resin layer was formed on the surface-treated steel sheet. In addition, the other surface of the surface-treated steel sheet (a surface to be located outside the can when the surface-treated steel sheet was worked into the metal can, as will be described later) was laminated, under the same conditions, with an organic resin layer using a non-orientated polyethylene terephthalate (PET) film (thickness of 13 μm) copolymerized with 15 mol % of isophthalic acid and containing titanium oxide as a white pigment. An organic resin-coated steel sheet was thus obtained.

Thereafter, paraffin wax was applied to both surfaces of the organic resin-coated steel sheet by an electrostatic oiling method, and the steel sheet was then punched out into a circular shape of a diameter of 143 mm, from which a cup was prepared through a shallow drawing process. The obtained cup was formed into a size of a diameter of 52.0 mm, a height of 111.7 mm, and a thickness of the can wall part to the original sheet thickness of −30% by performing a simultaneous drawing and ironing process two times for the cup. Doming process was then performed for the cup, which was heated by heat treatment of 220° C. for 60 seconds in order to release strains in the organic resin layers, and a metal can was thus obtained.

For the metal can thus obtained, the cross-cut corrosion resistance of the metal can was evaluated in accordance with the above-described method. The result is listed in Table 1.

Example 2

Procedures were the same as those in Example 1 except that the current density was 3 A/dm$^2$.

Example 3

Procedures were the same as those in Example 1 except that the conditions were a dipping time of 0.8 seconds, a current density of 3 A/dm$^2$, and a cycle time of 3 in the surface treatment line 100*a* illustrated in FIG. 2.

Example 4

Procedures were the same as those in Example 1 except that the conditions were a Zr concentration of 6,000 weight ppm, a F concentration of 7,000 weight ppm, a dipping time of 0.8 seconds, a current density of 5 A/dm$^2$, and a cycle time of 3 in the surface treatment line 100*a* illustrated in FIG. 2.

Example 5

Procedures were the same as those in Example 1 except that the surface treatment line 100*a* illustrated in FIG. 2 was used and the conditions were a line speed of 40 mm/min, a Zr concentration of 6,000 weight ppm, a F concentration of 7,000 weight ppm, a dipping time of 0.4 seconds, a current density of 8 A/dm$^2$, an energizing time of 0.3 seconds, an outage time of 1.3 seconds, and a cycle time of 3.

Example 6

Procedures were the same as those in Example 1 except that a cold-rolled low-carbon steel sheet of a thickness of 0.2 mm and a width of 1,000 mm was used as a raw sheet and the conditions were a line speed of 150 mm/min, a Zr concentration of 6,000 weight ppm, a F concentration of 7,000 weight ppm, a pH of the dip treatment liquid of 3, a dipping time of 2 seconds, a current density of 2 A/dm$^2$, and an outage time of 0.3 seconds.

Example 7

Procedures were the same as those in Example 1 except that a cold-rolled low-carbon steel sheet of a thickness of 0.2 mm and a width of 1,000 mm was used as a raw sheet and the conditions were a line speed of 150 mm/min, a Zr concentration of 6,000 weight ppm, a F concentration of 7,000 weight ppm, a pH of the dip treatment liquid of 3, a dipping time of 2 seconds, a current density of 5 A/dm$^2$, and an outage time of 0.3 seconds.

Example 8

Procedures were the same as those in Example 1 except that a cold-rolled low-carbon steel sheet of a thickness of 0.2 mm and a width of 1,000 mm was used as a raw sheet and the conditions were a line speed of 150 mm/min, a Zr concentration of 6,000 weight ppm, a F concentration of 7,000 weight ppm, a pH of the dip treatment liquid of 3, a dipping time of 0.9 seconds, a current density of 3 A/dm$^2$, an outage time of 0.3 seconds, and a cycle number of 3 in the surface treatment line 100*a* illustrated in FIG. 2.

Comparative Examples 1 to 3

Figure 4:
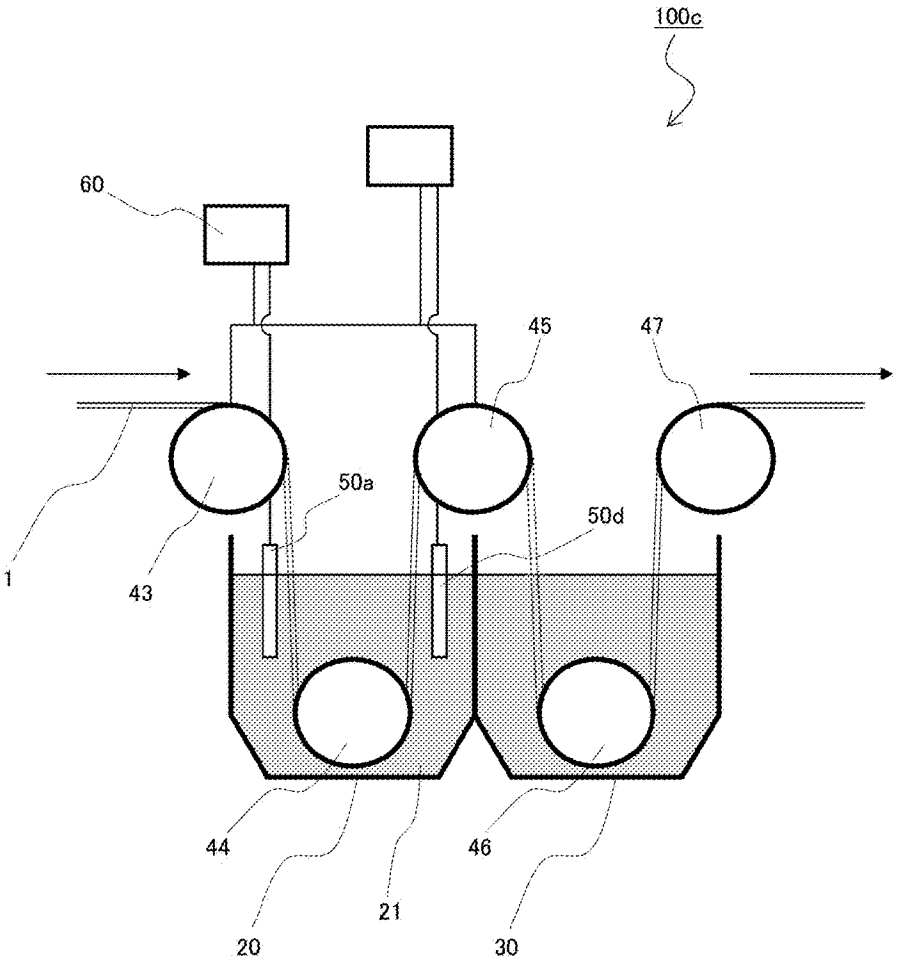
FIG. 4 is a view illustrating a configuration of a surface treatment line according to comparative examples.

Procedures were the same as those in Example 1 except that: a cold-rolled low-carbon steel sheet of a thickness of 0.2 mm and a width of 1,000 mm was used as a raw sheet in the surface treatment line 100*c* illustrated in FIG. 4; the Zr concentration, the F concentration and the pH of the electrolytic treatment liquid 21 used were those as listed in Table 1; and the line speed, the current density, the energizing time and the outage time were those as listed in Table 1.

TABLE 1

| | | Immersion treatment liquid and electrolytic treatment liquid | | | Immersion |
|---|---|---|---|---|---|
| | Line speed [m/min] | Zr concentration [ppm] | F concentration [ppm] | pH | time [sec] |
| Example 1 | 20 | 1000 | 1500 | 2.5 | 4.5 |
| Example 2 | 20 | 1000 | 1500 | 2.5 | 4.5 |
| Example 3 | 20 | 1000 | 1500 | 2.5 | 0.8 |
| Example 4 | 20 | 6000 | 7000 | 2.5 | 0.8 |
| Example 5 | 40 | 6000 | 7000 | 2.5 | 0.4 |
| Example 6 | 150 | 6000 | 7000 | 3 | 2 |
| Example 7 | 150 | 6000 | 7000 | 3 | 2 |
| Example 8 | 150 | 6000 | 7000 | 3 | 0.9 |
| Comparative Example 1 | 150 | 6000 | 7000 | 2.5 | 0 |
| Comparative Example 2 | 150 | 6000 | 7000 | 3 | 0 |
| Comparative Example 3 | 150 | 6000 | 7000 | 3 | 0 |

| | Electrolytic treatment conditions | | | | | Cross-cut |
|---|---|---|---|---|---|---|
| | Current density [A/dm$^2$] | Energizing time [sec] | Outage time [sec] | Cycle number [times] | Zr amount [mg/m$^2$] | corrosion resistance of metal can |
| Example 1 | 2 | 0.6 | 2.5 | 2 | 23 | 4 |
| Example 2 | 3 | 0.6 | 2.5 | 2 | 43 | 5 |
| Example 3 | 3 | 0.6 | 2.5 | 3 | 42 | 4 |
| Example 4 | 5 | 0.6 | 2.5 | 3 | 54 | 5 |
| Example 5 | 8 | 0.3 | 1.3 | 3 | 40 | 4 |
| Example 6 | 2 | 0.6 | 0.3 | 2 | 27 | 4 |
| Example 7 | 5 | 0.6 | 0.3 | 2 | 43 | 5 |
| Example 8 | 3 | 0.6 | 0.3 | 3 | 65 | 4 |

TABLE 1-continued

| | | | | | | |
|---|---|---|---|---|---|---|
| Comparative Example 1 | 5 | 0.6 | 0.3 | 2 | 52 | 3 |
| Comparative Example 2 | 5 | 0.6 | 0.3 | 2 | 44 | 3 |
| Comparative Example 3 | 7 | 0.6 | 0.3 | 2 | 60 | 3 |

In Examples 1 to 8, after the steel sheet was dipped for 0.1 to 10 seconds in the dip treatment liquid 11 which contained at least fluoride ions and had a pH of 2 to 5, the metal oxide layers were formed by means of electrolytic treatment. As listed in Table 1, in all of these examples, results of the evaluation of cross-cut corrosion resistance of the metal can were 4-point or higher. It has thus been confirmed that the organic resin layers well adhere to the metal oxide layers even after stresses are applied to the steel sheets when the steel sheets are worked and formed into metal cans.

On the other hand, in Comparative Examples 1 to 3, the time during which the etching treatment was performed for the surfaces of the steel sheet was zero seconds (i.e., the etching treatment was not performed for the surfaces of the steel sheet). In all of these comparative examples, results of the evaluation of cross-cut corrosion resistance of the organic resin-coated steel sheet were lower than 4-point. It has thus been confirmed that the interfacial adhesion of the organic resin layers formed on the metal oxide layers is poor.

DESCRIPTION OF REFERENCE NUMERALS

1 . . . Base material
100, 100*a*, 100*b*, 100*c* . . . Surface treatment line
10 . . . Dip treatment bath
11 . . . Dip treatment liquid
20 . . . Electrolytic treatment bath
21 . . . Electrolytic treatment liquid
30 . . . Rinsing treatment bath
41, 43, 45, 47 . . . Carrier roll
42, 44, 46 . . . Sink roll
50*a*, 50*b*, 50*c*, 50*d*, 50*e*, 50*f* . . . Anode
60 . . . Rectifier

What is claimed is:

1. A method of producing a surface-treated steel sheet comprising:

dipping a steel sheet for 0.1 to 10 seconds into a first treatment liquid that contains at least fluoride ions and has a pH of 2 to 5; and electrically treating by flowing a direct current between the steel sheet and an electrode in a second treatment liquid to form a layer that contains a metal oxide on a surface of the steel sheet, wherein aqueous solutions that contain the same constituents are used as the first treatment liquid and the second treatment liquid.

2. The method of producing a surface-treated steel sheet according to claim 1, wherein dipping includes continuously feeding the steel sheet into a dip treatment bath that is filled with the first treatment liquid thereby to dip the steel sheet into the first treatment liquid, and electrically treating includes, after dipping the steel sheet into the first treatment liquid, continuously feeding the steel sheet into an electrolytic treatment bath that is filled with the second treatment liquid which contains a metal ion and at least one electrode and electrically treating by flowing the direct current between the steel sheet and the electrode in the second treatment liquid.

3. The method of producing a surface-treated steel sheet according to claim 2, wherein aqueous solutions that contain the same constituents at the same content ratio are used as the first treatment liquid and the second treatment liquid.

4. The method of producing a surface-treated steel sheet according to claim 2, wherein the second treatment liquid contains ions of at least one kind of metal selected from Zr, Al and Ti.

5. The method of producing a surface-treated steel sheet according to claim 1, wherein the steel sheet is a cold-rolled steel sheet from which iron is exposed at at least one surface thereof.

6. The method of producing a surface-treated steel sheet according to claim 1, wherein a molar concentration of metal in the layer formed on the surface of the steel sheet is 0.3 mmol/m2 or more.

7. The method of producing a surface-treated steel sheet according to claim 1, wherein the layer that contains the metal oxide is formed on the surface of the steel sheet without pickling the steel sheet with acid.

* * * * *